United States Patent [19]

Verty et al.

[11] 4,099,783

[45] Jul. 11, 1978

[54] METHOD FOR THERMOSHAFT OIL PRODUCTION

[76] Inventors: Vladimir Grigorievich Verty, Ukhta, poselok Yarega, ulitsa Kosmonavtov, 4, kv. 29; Pavel Grigorievich Voronin, Ukhta, poselok Yarega, ulitsa Mira, 4, kv. 6; Evgeny Ivanovich Gurov, Ukhta, poselok Yarega, ulitsa Mira, 2, kv. 3; Vitaly Semenovich Zubkov, Ukhta, poselok Yarega, ulitsa Mira, 4-3; Nikolai Ivanovich Melnichuk, Ukhta, poselok Yarega, ulitsa Mira, 7, kv. 5; Grigory Grigorievich Miller, Ukhta, poselok Yarega, ulitsa Kosmonavtov, 4-59; Vladimir Nikiforovich Mishakov, Ukhta, poselok Yarega, ulitsa Pushkinskaya, 1, kv. 4; Vitaly Stepanovich Sukrushev, Ukhta, poselok Yarega, ulitsa Mira, 2-12; Leonid Mikhailovich Ruzin, Ukhta, poselok Yarega, ulitsa Kosmonavtov, 5, kv. 26, all of Komi ASSR; Vladimir Pavlovich Tabakov, ulitsa Sofii Kovalevskoi, 4a, kv. 125, Moscow, all of U.S.S.R.

[21] Appl. No.: 638,027

[22] Filed: Dec. 5, 1975

[51] Int. Cl.[2] ..... E21B 43/24; E21C 41/10

[52] U.S. Cl. ..... 299/2; 166/50; 166/272

[58] Field of Search ..... 166/50, 263, 272; 175/62; 299/2

[56] References Cited

U.S. PATENT DOCUMENTS

| | | | |
|---|---|---|---|
| 50,903 | 11/1865 | Casamajor | 299/2 |
| 1,520,737 | 12/1924 | Wright | 166/50 X |
| 1,634,235 | 6/1927 | Ranney | 299/2 |
| 1,660,187 | 2/1928 | Ehrat | 299/2 |
| 1,735,481 | 11/1929 | Uren | 299/2 |
| 1,811,560 | 6/1931 | Ranney | 299/2 |
| 1,816,260 | 7/1931 | Lee | 166/50 X |
| 2,210,582 | 8/1940 | Grosse et al. | 299/2 |
| 3,386,508 | 6/1968 | Bielstein et al. | 166/272 |
| 3,456,730 | 7/1969 | Lange | 166/272 X |
| 3,954,140 | 5/1976 | Hendrick | 166/50 |

*Primary Examiner*—Stephen J. Novosad
*Assistant Examiner*—George A. Suchfield
*Attorney, Agent, or Firm*—Lackenbach, Lilling & Siegel

[57] ABSTRACT

The method for thermoshaft oil production comprises the provision of a combination of mining holes above an oil-bearing bed which are inclined at from 1° to 3° to the horizon. Then injection holes are drilled from these mining openings for feeding a heating medium into the bed. After that, a slope and a footway leading to the bottom part of the oil-bearing bed are constructed, and a production gallery is provided within the bottom part of the bed. Horizontal and ascending holes are drilled from the production gallery for oil production. A heating medium is fed into the injection holes for uniform distribution thereof over the entire volume of the oil-bearing bed and for displacement of oil into the horizontal and ascending production holes towards the production gallery wherefrom the oil is fed up to the surface.

6 Claims, 4 Drawing Figures

METHOD FOR THERMOSHAFT OIL PRODUCTION

BACKGROUND OF THE INVENTION

The invention relates to the art of operating oil fields by the shaft method, and, more particularly, to a method for thermoshaft oil production.

The present invention may be most advantageously used in operating oil fields with highly viscous oils and mobile (fluid) bitumens.

The invention may also be used for operating low-pressure oil fields.

At present, such oil fields cannot be operated by conventional methods, such as using holes drilled from the surface since the oil yield is very low.

For operating oil fields with highly viscous oils or mobile bitumens, a shaft oil production method was used heretofore which involved production without lifting the oil-saturated rock up to the surface.

This thermoshaft of oil production comprises the provision of a system of mining openings 10–30 m above the roof of the production oil-bearing bed. Then the mining field is divided into several levels. Longitudinal field drifts with drilling chambers are made between the levels. According to a selected pattern, inclined and vertical holes are drilled into the production bed at a depth of about 40–70 m from the drilling chambers and are spaced at 40–60 m from one another. The hole depth depends on the thickness of the oil-bearing bed.

The distance between the hole bottoms, the number of holes and the pattern of arrangement of mining openings of this oil production method may vary.

The hole bottoms are uniformly distributed over the bed foot with the spacing of the hole bottoms being from 12 to 25 m.

The hole construction involves the provision of a four-inch casing string which is grounded at the mouth of the hole. The hole bottom is of the open type. The hole mouth is provided with elbow bends and fittings.

After the drilling, the holes are operated, first by the gusher method, and then by the airlift method.

Oil is collected and transported in an open-type system. The oil from the holes is fed into channels of the mining openings and is conveyed therealong by water to oil traps (hydraulic transportation). Oil with water is pumped from the traps into central underground oil collectors. Then, after primary handling and heating, the oil is pumped into oil storage tanks.

The above-described method enables, depending on the geological and physical characteristics of the production oilbearing bed and the fluids saturating it, the use of an optimal arrangement of the holes for operating oil fields so as to ensure an improved oil yield with low drilling costs.

This method also offers wide possibilities of using structural analysis for drilling directional holes into the zones of tectonic dislocations, non-operated zones and zones with elevated permeability of the bed.

In addition, the employment of this method simplifies production methods in drilling holes, oil production and transportation and enables elimination of the influence of climatic conditions on regularity of oil production operations.

However, inspite of a therefold improvement of oil yield of the bed, absolute oil yield is as low as about 6% when using this method as compared to the operation of holes drilled from the surface.

Furthermore, the use of this method results in the need for performing a large number of effort-consuming mining and drilling operations in empty oil-less rocks.

It should be also noted that a large scatter and an enormous number of operating holes considerably complicate the performance of extensive geological and technical measures associated with successful operation of the holes.

The above-described difficulties result in the need for the employment of oil production methods involving physical and chemical action on the production oil-bearing bed and the fluid saturating the same.

Known also in the prior art is a thermoshaft oil production method using a steam action on the production oil-bearing bed.

This method involves the provision of a combination using a steam action on the production oil-bearing bed.

This method involves the provision of a combination of mining openings above the oil-bearing bed.

Vertical and inclined holes are drilled from said mining openings. A part of the holes are used for feeding a heating medium (steam) into the production oil-bearing bed (injection holes), and the other holes are used for recovery of oil from the bed (production holes). It should be noted that all operations associated with feeding steam into the bed are performed using the common practice of feeding a heating medium through conventional holes drilled from the surface.

This method provides positive displacement of the oil with the steam from the bottoms of the injection holes to the bottoms of the production holes.

Accordingly, the holes are operated by the airlift method.

With small production volume, this method intensifies the process of oil production, reduces steam consumption for recovery of one ton of oil and reduces the number of concurrently operated injection holes as compared to similar known oil production methods.

However, with greater production volumes in recovering oil from production holes operated by the airlift method, sand plugs are frequently formed, and the holes are plugged with sand effluent from the production bed.

In addition, extra expenses are required for the provision of hole mouths with check fittings and the installation of conduits in the holes for the airlift operation, as well as an additional air supply for lifting fluid from the holes.

Apart from that, as a result of the combination of steam injection and oil production operations within the limits of the same mining openings, labor conditions and safety are impaired.

When steam injection pressure is increased above 5-6 $kg/cm^2$, steam may break through the cracks into overburden mining openings, and avalanches may also occur in the mining openings.

Continuous steam injection cannot be performed due to the small spacing between the holes.

Rest periods in during operation of the injection and production holes result in the formation of sand plugs, complications in the operation of the holes, difficulties encountered in the airlift hot oil production and, as a result of all this, a low oil yield of the production oil-bearing bed, heavy labor conditions and bad safety in the mine.

SUMMARY OF THE INVENTION

All of the above-noted prior art processes are more particularly described in U.S. Pat. Nos. 1,634,235 and 1,520,737 as well as in an article entitled "Horizontal Drilling From the Shaft Bottom in Pennsylvania" appearing in *National Petroleum News,* volume 34, dated Feb. 11, 1942.

It is the main object of the invention to provide a method for thermoshaft oil production which enables an improvement of the oil yield of a production oil-bearing bed and the efficiency of the oil production process as compared to similar known oil production methods.

Another object of the invention is to provide a method for thermoshaft oil production which enables simplification of the operation of the holes as compared to similar known oil production methods.

Still another object of the invention is to provide a method for thermoshaft oil production which enables an improvement of the labor conditions and the safety of the operating staff as compared to similar known oil production methods.

The above and other objects are accomplished by a method for thermoshaft oil production consisting of: providing a combination of mining openings above an oil-bearing bed which are inclined at from about 1° to about 3° to the horizon; drilling injection holes from said mining openings for feeding a heating medium into the oil-bearing bed; constructing a slope and a footway leading to the bottom part of the oil-bearing bed; providing a production gallery within said bottom part of the bed; drilling a system of horizontal production holes and ascending production holes from said production gallery for oil production; positively feeding a heating medium into said injection holes for uniform distribituion thereof over the entire volume of the oil-bearing bed and for displacement of oil into said horizontal and ascending production holes towards said production gallery; and recovering the oil from said production gallery.

According to the invention, an improvement in the method consists in the provision of two levels of mining openings, namely, the mining openings for feeding a heating medium into the bed and the production gallery for recovery of oil up to the surface which is located within the bottom part of the production bed.

An improvement of the oil yield of the bed is achieved due to the heating of the bed and the saturating fluid, and, as a result of lowering the viscosity of oil, an expansion of the bed fluid and an increase in the bed pressure is achieved.

The efficiency of oil production is achieved due to an increase in the oil yield by many times and an acceleration of the production in an oil field.

Oil production is simplified due to the drilling of ascending and horizontal production holes.

Gravity improves operating conditions of the holes.

Oil, water and sand effluent to the hole are moved into the production gallery so that no sand plugs are formed in the hole.

The method according to the invention offers the maximum possible degree of draining of the bed with holes, and at the same time, concurrently with the displacement conditions, this method provides the conditions for gravity performance with the greatest simplification of operation of the holes.

The vertical and inclined injection holes for feeding a heating medium into the oil-bearing bed are preferably drilled from said mining openings.

This enables the reduction of the volume of the mining openings above the oil-bearing bed.

The injection gallery is preferably constructed substantially within the top part of said oil-bearing bed from said mining openings with subsequent drilling, from this gallery, of horizontal and inclined injection holes for feeding a heating medium into the oil-bearing bed.

In this case, a heating medium is fed through a system of horizontal and inclined injection holes having a large extension in the production bed.

This enables a substantial reduction of the amount of effort-consuming mining operations in the overburden level and the amount of drilling in unproductive rocks so that the efficiency of the thermoshaft oil production method is considerably improved.

BRIEF DESCRIPTION OF THE DRAWINGS

The invention will now be described with reference to an embodiment thereof illustrated in the accompanying drawings, in which.

DESCRIPTION OF THE PREFERRED EMBODIMENTS

Figure 1:
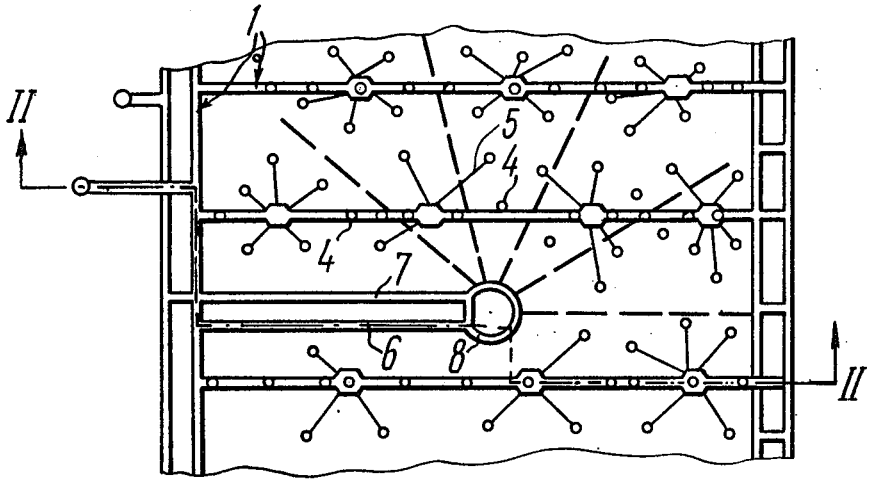
FIG. 1 shows an area of mining openings with vertical and inclined injection holes in a top, plan view (the mining openings are conventionally shown in one horizontal plane)

The method according to the invention is carried out in the following manner:

A combination of mining openings 1 are provided at an overburden level 2 above the roof of a production oil-bearing bed 3. The plane of the mining openings is inclined at about 1°–3° to the horizon.

Then vertical injection holes 4 and inclined injection holes 5 are drilled from said mining openings 1 for feeding a heating medium into the bed, such as steam. The steam may be suitably supplied to the bed 3 by a boiler house 14 via a steam-supply pipe or hole 15. Subsequently, a slope 6 and a footway 7 leading to the bottom part of the oil-bearing bed are constructed, and a production gallery 8 is provided within the bottom part of the bed. Horizontal production holes 9 and ascending production holes 10 are drilled from the production gallery 8. Other supporting equipment for an oil field embodying the present method comprise suitable hoisting and ventilation shafts 16 and 17, respectively.

The production oil-bearing bed 3 is heated to 50°–95° C by feeding a heating medium, such as steam, into the bed at regular intervals through the system of injection holes 4 and 5 of the overburden level 2.

Upon reaching the above-mentioned temperature, oil is recovered at regular intervals without suspending the intermittent steam supply into the bed. Then hot water, and subsequently cold water, is fed to replace the steam at regular intervals while continuing the oil recovery through the production holes 9 and 10 at regular intervals.

Due to the provision of the dense network of the injection holes 4 and 5, the oil-bearing bed 3 is uniformly and rapidly heated over its entire volume. This is facilitated by the presence of cracks in the bed 3.

Upon the temperature raise in the bed 3, the oil viscosity is lowered and its mobility is improved.

Pressure difference between the injection holes 4 and 5 and the production holes 9 and 10, capillary impregnation and gravity contribute to the oil displacement from the rock blocks of the bed 3 into the cracks and therefrom into the production holes 9 and 10 towards the production gallery 8 located within the bottom part of the bed 3.

A large opening area of the bed 3 with the production holes 9 and 10 and injection holes 4 and 5, as well as the above-mentioned factors, enables a substantial reduction of the filtration resistance to the oil flow in the bed 3.

The inflow of fluid into the developed network of the horizontal production holes 9 and ascending production holes 10 is effected as a result of both the pressure difference between the injection holes 4 and 5 and the production holes 9 and 10 and gravity.

The provision of the horizontal production holes 9 and ascending production holes 10 facilitates the operating conditions, eliminates the necessity of permanent attendance of the operating staff in the production gallery 8 and allows for automation of the oil production process.

There is also no need for frequent repair operations in the production holes 9 and 10 since the sand effluent from the bed 3 is washed off them with the oil and water.

A large number of injection holes 4 and 5 and a large opening area of the production bed 3 with the injection holes 4 and 5 eliminate the need for injecting a heating medium under high pressure so that the danger of steam break through into the mining openings 1 is reduced, if not completely eliminated.

Oil production through the system of horizontal and ascending production holes 9 and 10 permits a better utilization of the natural cracking of the bed 3 with predominant vertically oriented cracks.

Insofar as the oil recovery and heating medium supply are effected from different levels, labor conditions and safety of the operating staff are improved.

In another embodiment, the injection holes for feeding a heating medium into the oil-bearing bed 3 (FIG. 4) are drilled from said mining openings 1 (FIG. 3) after constructing an injection gallery 11 substantially within the top part of the oil-bearing bed 3.

Then horizontal injection holes 12 and inclined injection holes 13 are drilled from the gallery 11 for feeding a heating medium into the bed 3. The injection holes 12 and 13 have a large extension within the oil-bearing bed 3.

This permits a reduction of the effort-consuming operations in the overburden level and volume of the drilling in unproductive rocks.

Figure 2:
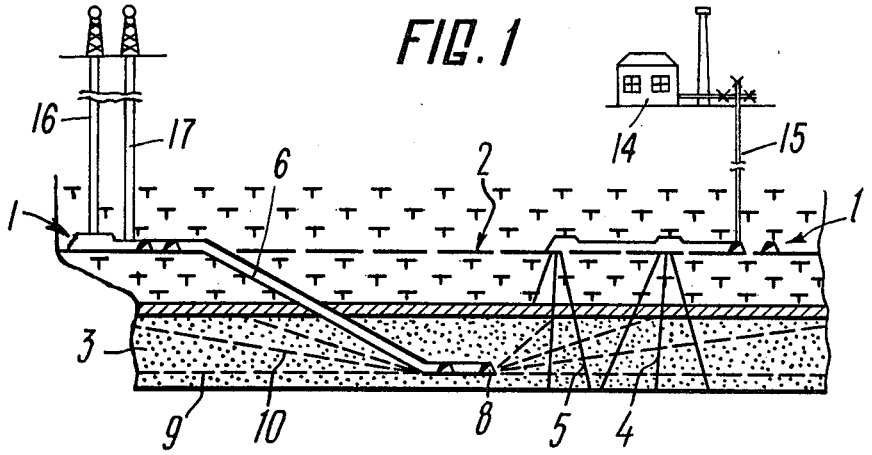
FIG. 2 is a cross sectional view taken along the line II—II in FIG. 1.
Figure 3:
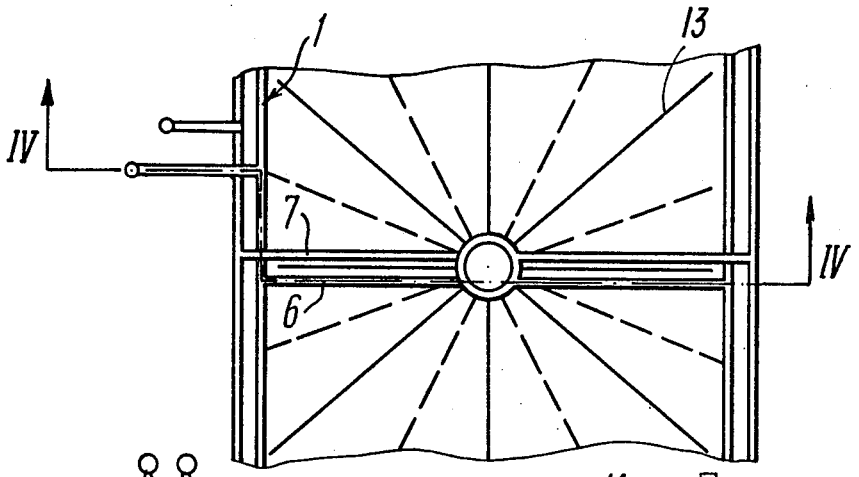
FIG. 3 shows an area of mining openings with horizontal and inclined injection holes in a top, plan view (the mining openings are conventionally shown in one horizontal plane)
Figure 4:
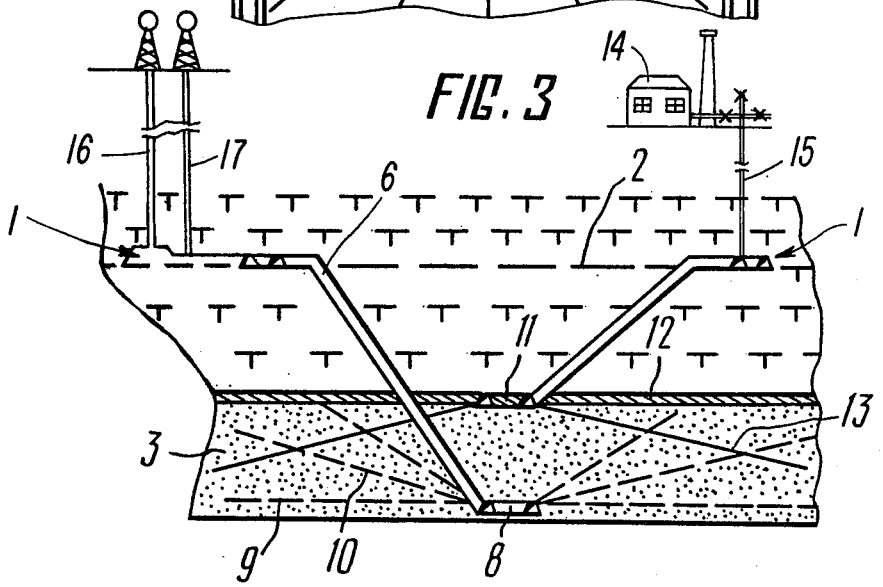
FIG. 4 is a cross sectional view taken along the line IV-IV in FIG. 3.

It will be appreciated that steam from the boiler house 14 is fed via steam pipes at the surface of the ground through a steam supply hole 15 into the shaft steam pipes through which the steam is distributed to the underground injection holes 4, 5 with respect to FIGS. 1 and 2, and reference numerals 12 and 13 with respect to FIGS. 3 and 4. The oil is recovered from the production holes and is suitably fed into tanks (not shown) in the production gallery 8, whence it is pumped into tanks in the mining openings of the overburden level 2. Accordingly, the steam is pumped in and the oil is recovered independently of each other.

The present invention may be not least advantageously used in the production of mobile (fluid) bitumens.

What is claimed is:

1. A method for thermoshaft oil production of viscous oils or fluid bitumens wherein mining openings are provided above an oil-bearing bed at an overburden level comprising forming said mining openings with an inclination of from about 1° to about 3° to the horizon; drilling injection holes from said mining openings for feeding a heating medium into said oil-bearing bed; constructing a slope and a footway from at least one mine opening leading to the bottom part of said oil-bearing bed to a production gallery which is provided within the bottom part of said bed; drilling a system of horizontal and ascending holes for oil production from said production gallery; positively feeding a heating medium into said injection holes for uniform distribution thereof over the entire volume of said oil-bearing bed and for displacement of oil into said horizontal and ascending production holes towards said production gallery; and recovering the oil from said production gallery.

2. A method according to Claim 1, wherein said injection holes are vertical and inclined and are drilled from said mining openings for feeding a heating medium into said oil-bearing bed.

3. A method according to claim 1, wherein an injection gallery is constructed substantially within the top part of said oil-bearing bed from said mining openings with subsequent drilling, from said gallery, of horizontal and inclined in injection holes for feeding a heating medium into said oil-bearing bed.

4. A method according to claim 1, wherein said heating medium is steam.

5. A method according to claim 4, wherein said oil-bearing bed is heated to about 50°–95° C by said heating medium.

6. A method according to claim 5, wherein, after said temperature range is obtained, at regular intervals oil is recovered through said production holes, and a fluid, in the form of hot water and subsequently cold water, is fed to said injection holes to replace said steam, so as to continue the oil displacement and resultant recofery of same from said bed.

* * * * *